US008665193B2

(12) United States Patent
Han et al.

(10) Patent No.: US 8,665,193 B2
(45) Date of Patent: Mar. 4, 2014

(54) LIQUID CRYSTAL DISPLAY

(75) Inventors: Eun-Hee Han, Seoul (KR); Hee-Seop Kim, Hwasung-si (KR); Jun-Young Lee, Yongin-si (KR); Chang-Hun Lee, Yongin-si (KR); Jun-Woo Lee, Anyang-si (KR); Sung-Wook Kang, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1836 days.

(21) Appl. No.: 11/488,405

(22) Filed: Jul. 18, 2006

(65) Prior Publication Data

US 2007/0018924 A1 Jan. 25, 2007

(30) Foreign Application Priority Data

Jul. 21, 2005 (KR) ..... 10-2005-0066284

(51) Int. Cl.
*G09G 3/36* (2006.01)

(52) U.S. Cl.
USPC ..... 345/87; 345/204; 345/691; 349/19

(58) Field of Classification Search
USPC ..... 345/87, 691, 204; 349/118
See application file for complete search history.

(56) References Cited

U.S. PATENT DOCUMENTS

| | | | | |
|---|---|---|---|---|
| 5,627,560 | A | 5/1997 | Verhulst | 345/97 |
| 5,825,445 | A * | 10/1998 | Okamoto et al. | 349/118 |
| 6,671,017 | B2 * | 12/2003 | Lyu et al. | 349/118 |
| 6,693,618 | B2 | 2/2004 | Son et al. | |
| 6,812,910 | B2 | 11/2004 | Chou | 345/90 |
| 6,859,246 | B2 * | 2/2005 | Konno et al. | 349/128 |
| 7,106,350 | B2 * | 9/2006 | Baba et al. | 345/691 |
| 2001/0052886 | A1 | 12/2001 | Ikeda | |
| 2002/0003522 | A1 | 1/2002 | Baba et al. | |
| 2004/0239609 | A1 * | 12/2004 | Lee et al. | 345/100 |
| 2005/0088386 | A1 | 4/2005 | Kao et al. | |

FOREIGN PATENT DOCUMENTS

| | | | | |
|---|---|---|---|---|
| CN | 1371087 | | 9/2002 | |
| JP | 11109921 | A * | 4/1999 | |
| JP | 2001-042282 | | 2/2001 | G02F 1/133 |
| JP | 2002-006284 | | 1/2002 | |
| JP | 2003-255915 | | 9/2003 | G09G 3/36 |
| JP | 2003-271110 | | 9/2003 | G09G 3/36 |
| JP | 2003270669 | A * | 9/2003 | |
| JP | 2003-280036 | | 10/2003 | G02F 1/1368 |
| JP | 2003-295156 | | 10/2003 | |
| JP | 2004-046236 | | 2/2004 | G09G 3/36 |
| JP | 2004-126470 | | 4/2004 | G09G 3/36 |
| JP | 2005-049819 | | 2/2005 | G09G 3/36 |

(Continued)

*Primary Examiner* — Grant Sitta
(74) *Attorney, Agent, or Firm* — F. Chau & Associates, LLC

(57) ABSTRACT

An OCB (Optically Compensated Bend) liquid crystal display in which impulse driving is performed such that an impulse data voltage is applied between normal data voltages used for displaying an image. The impulse data voltage is divided into a first impulse data voltage and a second impulse data voltage having a voltage value that will not break a bent alignment of the OCB liquid crystals. Referring to the application of the first impulse data voltage between the normal data voltages as first impulse driving and the application of the second impulse data voltage between the normal data voltages as second impulse driving, the second impulse driving is performed at every two or more of the first impulse drivings, so as to not break the bent alignment of the liquid crystals and to thereby improve luminance of the LCD.

17 Claims, 5 Drawing Sheets

(56) References Cited

FOREIGN PATENT DOCUMENTS

| | | | |
|---|---|---|---|
| KR | 1020010093034 | 10/2001 | G09G 3/36 |
| KR | 1020020070911 | 9/2002 | G02F 1/133 |
| KR | 1020030004872 | 1/2003 | G02F 1/133 |
| KR | 1020030020694 | 3/2003 | G09G 3/36 |
| KR | 1020030059551 | 7/2003 | G02F 1/133 |
| KR | 1020040004858 | 1/2004 | G02F 1/133 |
| KR | 1020040013961 | 2/2004 | G09G 3/36 |
| KR | 1020040077012 | 9/2004 | G02F 1/133 |
| KR | 1020050001723 | 1/2005 | G02F 1/133 |

* cited by examiner

| g2 Application Period | Tendency Of Luminance | Tendency Of Bent Alignment Sustaining Power |
|---|---|---|
| per 2 frame | | Increasing |
| per 3 frame | | |
| | | |
| per 30 frame | Increasing | |

LIQUID CRYSTAL DISPLAY

CROSS-REFERENCE TO RELATED APPLICATION

This application claims priority to and the benefit of Korean Patent Application No. 10-2005-0066284 filed in the Korean Intellectual Property Office on Jul. 21, 2005, the entire contents of which are incorporated herein by reference.

BACKGROUND OF THE INVENTION (a) Technical Field

The present disclosure relates to a liquid crystal display (LCD).

(b) Discussion of the Related Art

An LCD is one of the most widely used flat panel displays. The LCD includes two glass substrates with electrodes formed thereon and a liquid crystal layer interposed therebetween, in which a voltage applied to the two electrodes is varied to change an alignment of liquid crystal molecules to thereby control the amount of transmittance of light so as to display an image on a screen.

Various methods have been proposed to improve a response speed and a viewing angle of the LCD, one example of which is the OCB (Optically Compensated Bend) type of LCD.

The OCB type of LCD includes electrodes formed on each of the two facing substrates, a liquid crystal layer injected between the substrates, and an alignment film formed on each of the substrates for aligning liquid crystal molecules to be parallel with the glass sheets forming substrates. In the OCB type of LCD, when an electric field is applied to the two substrates, liquid crystal molecules are aligned to be symmetrical to an imaginary center plane between the two substrates and have such a structure that their horizontal alignment at both substrates changes to a vertical alignment when reaching the center plane, so a wide viewing angle can be obtained. In order to obtain such alignment of the liquid crystal molecules, each alignment layer of the two substrates is processed to have the same direction and a high voltage is initially applied to obtain the bent alignment.

The above information disclosed in this background section is only for enhancement of understanding of the background of the invention and therefore it may contain information that does not form the prior art that is already known in this country to a person of ordinary skill in the art.

SUMMARY OF THE INVENTION

A liquid crystal display in accordance with an embodiment of the present invention comprises first and second electrodes formed to face each other and a liquid crystal layer formed between the first and second electrodes and having a bent alignment, wherein a normal data voltage that indicates a luminance corresponding to external image information and an impulse data voltage that indicates a lower luminance than that of the normal data voltage with respect to at least one gray level are alternately applied to the first electrode, the impulse data voltage includes a first impulse data voltage with a value changing according to the external image information and a second impulse data voltage with a value that does not break the bent alignment, and the number of applications of the first impulse voltage is two times or more the number of applications of the second impulse voltage.

A period during which the second impulse data voltage is applied may be two times or more a period during which the first impulse data voltage is applied.

A period during which the second impulse data voltage is applied may be 500 ms or smaller.

A period during which the second impulse data voltage is applied may be within the range of 2 frames to 30 frames.

The second impulse data voltage may refer to data that indicates black.

Certain portions of the first impulse data that are below a certain gray level may refer to data that indicates black.

A portion of the first impulse data at the highest gray level may refer to data that indicates white.

The liquid crystal display can be in a normally white mode.

When a time ratio of the normal data voltage and the impulse data voltage is a duty ratio, the duty ratio can be 1:1 to 4:1.

The liquid crystal display includes a plurality of pixels arranged in a matrix form, and after the normal image data is applied to all the plurality of pixels, the first or second impulse data voltage is applied to the plurality of pixels.

The liquid crystal display includes the plurality of pixels arranged in a matrix form, and the normal image data can be applied to some pixels and the first or second impulse data voltage can be applied to the remaining pixels.

A polarizer can be attached at each outer side of the liquid crystal display.

A transmissive axis of each of the polarizers can be perpendicular to each other.

A compensation film can be attached on an inner side of the polarizer.

As the compensation film, a C plate compensation film or a biaxial compensation film can be used.

DESCRIPTION OF EXEMPLARY EMBODIMENTS

Figure 1:
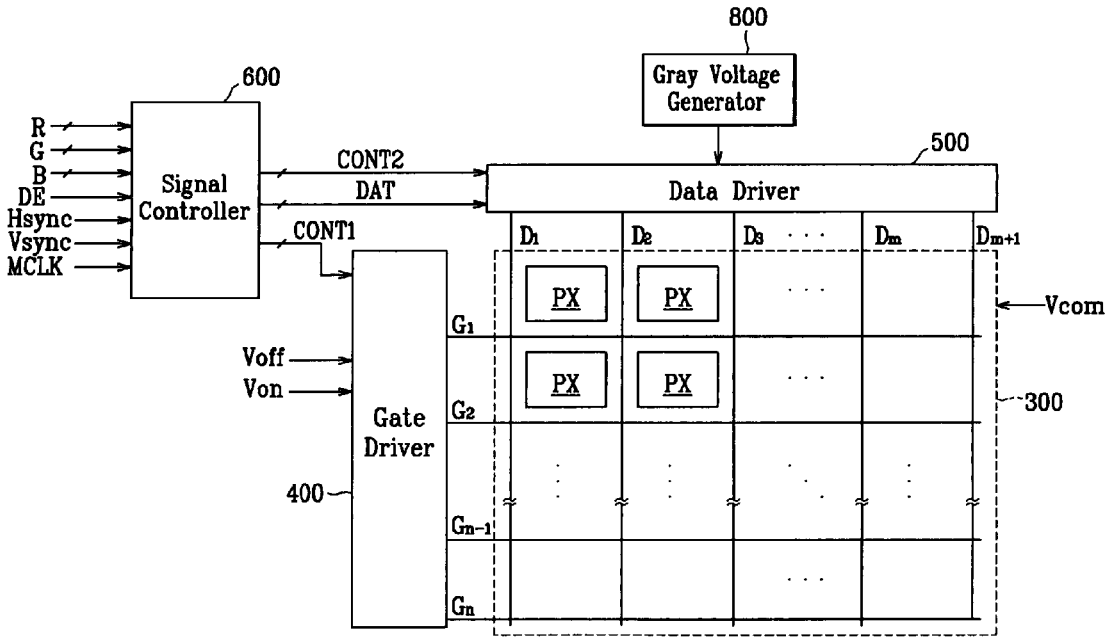
FIG. 1 is a block diagram of a liquid crystal display according to an exemplary embodiment of the present invention.

An OCB liquid crystal display (LCD) has a problem in that when a voltage drops below a certain voltage level, a bent alignment of liquid crystals can be broken.

Thus, in order to prevent the bent alignment of the liquid crystals from being broken, a voltage of a certain level or higher is applied to pixels of the LCD.

In this respect, however, even though the bent alignment of the liquid crystals may not be broken, display luminance of the LCD is degraded.

An embodiment of the present invention is intended to solve such a problem of the related art and to provide an OCB liquid crystal display that is capable of preventing degradation of display luminance and to prevent a bent alignment of liquid crystals from being broken, and a driving method therefor.

In an embodiment of the present invention, impulse driving is performed such that impulse data voltages are applied between normal data voltages used for displaying an image. In this case, the impulse data voltages can be divided into a first impulse data voltage and a second impulse data voltage having a voltage level that will not break a bent alignment of OCB liquid crystals, and in the case where the first impulse data voltage is applied between the normal data voltages, referred to as a first impulse driving, and the case where the second impulse data voltage is applied between the normal data voltages, referred to as a second impulse driving, the second impulse driving is performed at every two or more occurrences of the first impulse drivings. More specifically, a period during which the second impulse driving is performed can be within the range of 2 frames to 30 frames.

With reference to the accompanying drawings, an embodiment of the present invention will be described in order for those skilled in the art to be able to implement the embodiment. As those skilled in the art would realize, the described embodiments may be modified in various different ways, all without departing from the spirit or scope of the present invention.

To clarify multiple layers and regions, the thicknesses of the layers are enlarged in the drawings.

Like reference numerals designate like elements throughout the specification.

When it is said that any part, such as a layer, film, area, or plate is positioned on another part, it means the part is directly on the other part or above the other part with at least one intermediate part.

On the other hand, if any part is said to be positioned directly on another part it means that there is no intermediate part between the two parts.

To begin with, a liquid crystal display (LCD) in accordance with an exemplary embodiment of the present invention will be described in detail with reference to FIGS. 1 and 2.

Figure 2:
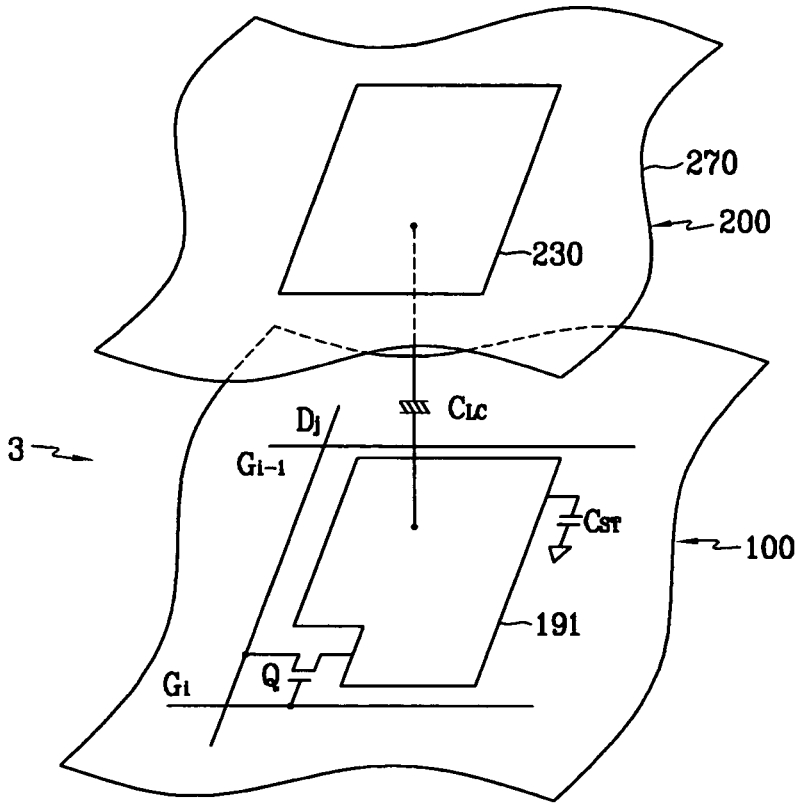
FIG. 2 is an equivalent circuit diagram showing a single pixel of the liquid crystal display according to an exemplary embodiment of the present invention.

FIG. 1 is a block diagram of a liquid crystal display (LCD) according to an exemplary embodiment of the present invention, and FIG. 2 is an equivalent circuit diagram showing a single pixel of the liquid crystal display according to an exemplary embodiment of the present invention.

As shown in FIG. 1, the LCD according to the exemplary embodiment of the present invention comprises a liquid crystal panel assembly 300, a gate driver 400 and a data driver 500 connected with the liquid crystal panel assembly 300, a gray voltage generator 800 connected with the data driver 500, and a signal controller 600 for controlling these units.

In terms of an equivalent circuit, the liquid crystal panel assembly 300 comprises a plurality of display signal lines ($G_1$-$G_n$ and $D_1$-$D_m$) and a plurality of pixels PX connected with the plurality of display signal lines ($G_1$-$G_n$ and $D_1$-$D_m$) and arranged substantially in a matrix form.

Meanwhile, in terms of the structure shown in FIG. 2, the liquid crystal panel assembly 300 comprises the lower and upper panels 100 and 200 and a liquid crystal layer represented at 3 is interposed therebetween.

Figure 3:
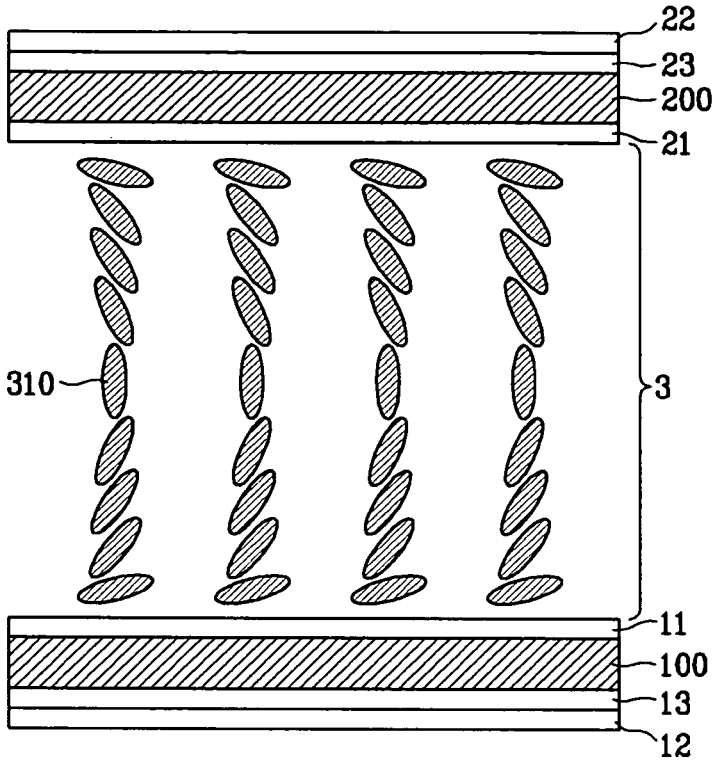
FIG. 3 is a cross-sectional view of an OCB (optically compensated bend) liquid crystal display.

As shown in FIG. 3, the liquid crystal layer 3 includes OCB (Optically Compensated Bend) liquid crystals which are bent to be symmetrical to an imaginary central surface between the lower and upper panels 100 and 200.

The signal line ($G_1$-$G_n$, $D_1$-$D_m$) include the plurality of gate lines ($G_1$-$G_n$) for transferring gate signals also called "scan signals", and the plurality of data lines ($D_1$-$D_m$) for transferring data signals.

The gate lines ($G_1$-$G_n$) are formed to be substantially parallel with each other in a row direction and the data lines ($D_1$-$D_m$) are formed to be substantially parallel with each other in a column direction.

Each pixel PX, for example, the pixel connected with the ith (i=1, 2, . . . , n) gate line (Gi) and the jth (j=1, 2, . . . , m) data line (Dj), comprises a switching element Q connected with the signal lines (G1 and Dj), a liquid crystal capacitor $C_{lc}$, and a storage capacitor $C_{st}$ connected therewith.

The storage capacitor $C_{st}$ can be omitted as necessary.

The switching element Q is a three-terminal element such as a thin film transistor (TFT) provided at the lower panel 100, of which a control terminal is connected with the gate lines ($G_1$-$G_n$), an input terminal is connected with the data lines ($D_1$-$D_m$), and an output terminal is connected with the liquid crystal capacitor $C_{lc}$ and the storage capacitor $C_{st}$.

The liquid crystal capacitor $C_{lc}$ includes a pixel electrode 191 of the lower panel 100 and a common electrode 270 of the upper panel 200, and the liquid crystal layer 3 between the two electrodes 191 and 270 serves as a dielectric material.

The pixel electrode 191 is connected with the switching element Q, and the common electrode 270 is formed on the entire surface of the upper panel 200 and receives a common voltage (Vcom).

As an alternate to the showing in FIG. 2, the common electrode 270 can be provided on the lower panel 100, and in this case, at least one of the two electrodes 191 and 270 can have a linear or bar shape.

The storage capacitor $C_{st}$, which helps the liquid crystal capacitor $C_{lc}$ and is formed as a separate (additional or extra) signal line (not shown), and the pixel electrodes 191 which are provided at the lower panel 100, overlap with an insulator interposed therebetween, and a pre-set voltage such as the common voltage (Vcom) is applied to the separate signal line.

Also, the storage capacitor $C_{st}$ can be formed as the pixel electrode 191 overlaps with a uppermost front end gate line by the medium of the insulator.

In order to implement color display, each pixel PX specially displays one of primary colors, that is, spatial division, or each pixel PX displays the primary colors alternately over time, that is, time division, so that a desired color can be recognized by the spatial and temporal sum of the primary colors.

For example, the primary colors can be the three primary colors such as red, green, and blue colors.

FIG. 2 shows one example of the spatial division in which each pixel PX includes a color filter 230 representing one of the primary colors on a region of the upper panel 200.

As an alternative to the showing in FIG. 2, the color filter 230 can be formed at an upper or lower side of the pixel electrode 191 of the lower panel 100.

The LCD can further comprise a backlight unit (not shown) for providing light to the display panels 100 and 200 or the liquid crystal layer 3.

Polarizers 12 and 22 are provided at each of the outer surfaces of the display panels 100 and 200, and preferably, the transmissive axes of the two polarizers 12 and 22 are perpendicular to each other.

Compensation films 13 and 23 can be attached between the polarizers 12 and 22 and the display panels 100 and 200, and as the compensation films 13 and 23, a C plate compensation film or a bi-axial compensation film can be used.

The liquid crystal layer 3 includes nematic liquid crystals having positive dielectric anisotropy and are aligned according to an optically compensated bend (OCB) method, making a bent alignment as shown in FIG. 3.

The OCB LCD in accordance with the present exemplary embodiment displays normally white, that is, it displays a white color which is the brightest luminance, in a state that a voltage is not applied.

Referring back to FIG. 1, the gray voltage generator 800 generates one or two gray voltage sets related to the transmittance of the pixels PXs.

In the latter case, the two gray voltage sets are generated based on different gamma curve lines, which will be described later with reference to FIG. 6.

The gate driver 400 is connected with the gate lines ($G_1$-$G_n$) of the liquid crystal panel assembly 300, and applies a gate signal having the combination of a gate-on voltage (Von) and a gate-off voltage (Voff) to the gate lines ($G_1$-$G_n$).

The data driver 500 is connected with the data lines ($D_1$-$D_m$) of the liquid crystal panel assembly 300, selects a gray voltage from the gray voltage generator 800, and applies the gray voltage as a data signal to the data lines ($D_1$-$D_m$).

In this respect, if the gray voltage generator 800 provides only the predetermined number of reference gray voltages rather than all the voltages for all the gray levels, the data driver 500 divides the reference gray voltages to generate gray voltages for the entire gray levels and selects data signals from them.

The signal controller 600 controls the gate driver 400 and the data driver 500.

The units 400, 500, 600, and 800 can be integrally mounted in the form of at least one integrated circuit chip on the liquid crystal panel assembly 300, they can be mounted on a flexible printed circuit film (not shown) so as to be attached in the form of a TCP (Tape Carrier Package) on the liquid crystal panel assembly 300, or they can be mounted on a separate printed circuit board (not shown).

On the other hand, the units 400, 500, 600, and 800 can be integrated on the liquid crystal panel assembly 300 together with the signal lines ($G_1$-$G_n$ and $D_1$-$D_m$) and the TFT switching element Q, etc.

The units 400, 500, 600, and 800 can be integrated as a single chip, and in this case, at least one of the units 400, 500, 600, and 800 or at least one circuit element constituting them can be positioned at an outer side of the single chip.

The operation of the LCD will be described with reference to FIGS. 4 and 5.

Figure 4:
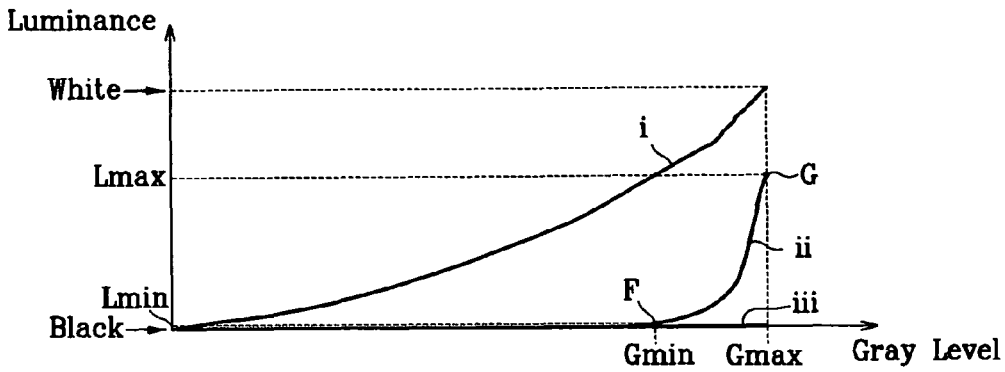
FIG. 4 shows a gray-to-luminance graph according to data when the liquid crystal display is driven according to an exemplary embodiment of the present invention.
Figure 5:
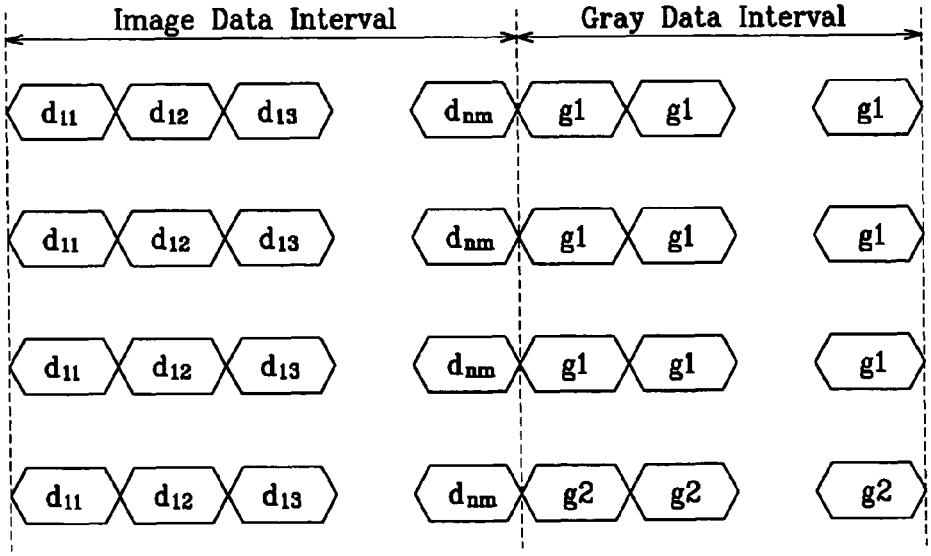
FIG. 5 is a drawing showing a data application method in the liquid crystal display according to an exemplary embodiment of the present invention.

FIG. 4 shows a gray-to-luminance graph of data when the liquid crystal display is driven according to an exemplary embodiment of the present invention, and FIG. 5 is a representation of a data application method in the liquid crystal display according to an exemplary embodiment of the present invention.

The signal controller 600 receives input image signals R, G, and B from an external graphics controller (not shown), and input control signals for controlling the display thereof.

The input image signals R, G, and B include luminance information of each pixel PX, and the luminance includes a predetermined number of gray levels, for example, 1024($=2^{10}$), 256($=2^8$), or 64($=2^6$).

The input control signals include, for example, a vertical synchronization signal Vsync, a horizontal synchronizing signal Hsync, a main clock signal MCLK, a data enable signal DE, etc.

The signal controller 600 appropriately processes the input image signals R, G, and B based on the input image signals R, G, and B and the input control signals according to operation conditions of the liquid crystal panel assembly 300 and the data driver 500, generates a gate control signal CONT1 and a data control signal CONT2, etc., and outputs the gate control signal CONT1 to the gate driver 400 and the data control signal CONT2 and a processed image signal DAT to the data driver 500.

The gate control signal CONT1 comprises a scanning start signal (STV) for indicating start of scanning, and at least one clock signal for controlling an output period of a gate-on voltage Von.

The gate control signal CONT1 may further comprise an output enable signal (OE) for limiting duration of the gate-on voltage.

The data control signal CONT2 comprises a horizontal synchronization start signal (STH) for indicating that transmission of image data with respect to pixels PXs of one line starts, a load signal (LOAD) for indicating application of a data signal to the data lines ($D_1$-$D_m$), and a data clock signal (HCLK).

The data control signal CONT2 may further comprise an inversion signal (RVS) for inverting the voltage polarity of the data signal with respect to the common voltage (Vcom), referred to hereinafter as 'polarity of a data signal' for 'voltage polarity of a data signal with respect to the common voltage (Vcom)'.

With reference to FIG. 5, the image signal DAT outputted by the signal controller 600 to the data driver 500 includes normal image data ($d_{11}$-$d_{nm}$), first impulse data (g1), and second impulse data (g2).

The normal image data ($d_{11}$-$d_{nm}$) and the first impulse data (g1) can have the same gray value, and in this case, the gray voltage generator 800 generates two gray voltage sets.

In this respect, however, the input image signals R, G, and B can be corrected to generate the first impulse data (g1) according to a defined rule, and in this case, the gray voltage generator 800 can generate only one gray voltage set.

The second impulse data (g2) is a predetermined gray level, for example, the lowermost gray level (referred to hereinafter as 'black gray level').

In addition, the second impulse data (g2) can be a value dependent on the input image signals R, G, and B. Herein, a curved line (i) is a luminance curve (gamma curved line) of the normal image data ($d_{11}$-$d_{nm}$) and a curved line (ii) is a luminance curved line of the first impulse data (g1). Line (iii) represents the second impulse data.

The curved line (i) is determined according to characteristics of the LCD, and the curved line (ii) indicates black with respect to gray levels lower than a certain gray level (Gmin) indicated by 'F', and it indicates monotone increasing luminance with respect to gray levels of the certain level (Gmin) or higher.

The monotone increasing luminance can be determined in consideration of the characteristics of the LCD.

In particular, a voltage value at the highest gray level (Gmax) of the curved line (ii) is smaller than a voltage referred to hereinafter as 'threshold voltage (Vc)' at which a bent alignment of the OCB liquid crystals is broken.

The voltage value at the highest gray level (Gmax) of the curved line (ii) can be a voltage value that indicates the highest luminance.

Preferably, a voltage corresponding to the second impulse data has a higher value than the threshold voltage (Vc).

A point 'G' of the curved line (ii) in FIG. 4 indicates the highest gray level (Gmax) of the first impulse data (g1), and the luminance in this case is Lmax.

A point 'F' indicates the lowermost value (Lmin), not 0, of luminance, and a gray level in this case is Gmin.

The luminance (Lmax) of the point 'G' and the gray level of the point 'F' can be varied.

The data driver 500 receives the normal image data ($d_{11}$-$d_{nm}$), the first impulse data (g1), and the second impulse data (g2) according to the data control signal (CONT2) transmitted from the signal controller 600, and converts them into a normal analog data voltage and a first or second impulse analog data voltage.

If there are two gray voltage sets generated by the gray voltage generator 800, the normal analog data voltage is selected from the two gray voltage sets of the gray voltage generator 800 that can satisfy the curved line (i) of FIG. 4, and the first impulse analog data voltage is selected from the two gray voltage sets of the gray voltage generator 800 that can satisfy the curved line (ii) of FIG. 4.

Subsequently, the data driver 500 applies the normal data voltage and the first or the second impulse data voltage to corresponding data lines ($D_1$-$D_m$).

The gate driver 400 applies the gate-on voltage Von to the gate lines ($G_1$-$G_n$) according to the gate control signal (CONT1) transferred from the signal controller 600 to turn on the switching element Q connected with the gate lines ($G_1$-$G_n$).

Then, a data signal applied to the data lines ($D_1$-$D_m$) can be applied to a corresponding pixel PX through the turned-on switching element Q.

A difference between the data signal applied to the pixel PX and the common voltage (Vcom) appears as a charge voltage of the liquid crystal capacitor Clc, namely, a pixel voltage.

Liquid crystal molecules are varied in their alignment according to a size of the pixel voltage, and accordingly, polarization of light transmitted through the liquid crystal layer 3 changes.

The change in the polarization appears as a change in transmittance of light because of polarizers 12 and 22 attached to the display panel assembly 300.

The above process is repeatedly performed by the units of 1 horizontal period, which can also be indicated by '1H' and is the same as one period of the horizontal synchronization signal (Hsync) and the data enable signal (DE), to sequentially apply the gate-on voltage (Von) to all the gate lines ($G_1$-$G_n$) to apply the data signal to all the pixels PXs to thereby display an image of one frame.

As shown in FIG. 5, the signal controller 600 alternately outputs the normal image data ($d_{11}$-$d_{nm}$) and the first impulse data (g1) or the second impulse data (g2), and there can be various ways to apply the first or second impulse data voltage corresponding to the first impulse data (g1) or the second impulse data (g2) to the pixels PXs.

Several examples will be described as follows.

A first method is that the normal data voltage is applied one time to every pixel, and then the first or second impulse data voltage is applied to every pixel.

A second method is that all the pixels are discriminated by the units of pixel lines, and the normal data voltage is applied to some of the pixel lines and the first or second impulse data voltage is applied to the remaining pixel lines.

In this case, there can be two methods for applying the first or second impulse data voltage to the remaining pixel lines. That is, according to one method, the first or second impulse data voltage can be applied to one pixel line by pixel lines in turn, and according to the other method, the first or the second impulse data voltage can be applied to the plurality of pixel lines at one time.

A third method is that the normal data voltage is applied to some of the pixels and then the first or second impulse data voltage is applied to the same pixels.

In this case, the first or second impulse data voltage can be sequentially applied by the units of pixel lines or applied at one time.

When one frame is finished, the next frame starts, and a state of the inversion signal (RVS) applied to the data driver 500 is controlled ('frame inversion') such that polarity of a data signal applied to each pixel PX can be the opposite to that of the data signal of the previous frame.

In this case, even in one frame, polarity of the data signal flowing through one data line can be changed according to the characteristics of the inversion signal (RVS), for example, line inversion or point inversion, or polarity of data signals applied to one pixel line can be different, for example, column inversion or point inversion.

The application of the first and second impulse data voltages will now be described in detail with reference to FIG. 5.

In the following description, the application of the first or second impulse data voltage between the normal data voltages is referred to as 'impulse driving'.

Herein, the application of the first impulse data voltage is called 'first impulse driving', and the application of the second impulse data voltage is called 'second impulse driving'.

FIG. 5 illustrates an exemplary embodiment in which the first impulse driving is performed three times repeatedly and then the second impulse driving is performed.

A period during which the second impulse driving is performed can be varied, and preferably the period is within the range of 2 frames to 30 frames.

The reason why the period of the second impulse driving is preferably not greater than 30 frames will be described later.

Figures 6, 7:
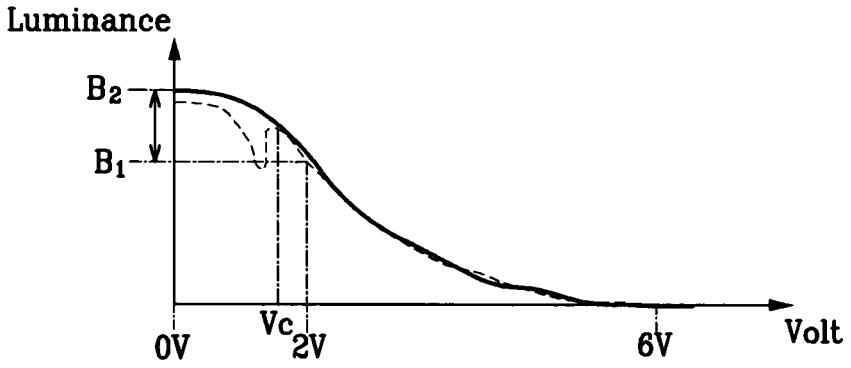
FIG. 6 is a graph showing display luminance according to applied voltages according to an exemplary embodiment of the present invention.
FIG. 7 is a view showing luminance and bent alignment sustaining power of the liquid crystal display according to an exemplary embodiment of the present invention.

FIG. 6 is a graph showing luminance according to voltages in the case where only the normal data voltage is applied, as indicated by a dotted curved line, and a case where the first or second impulse data voltage is applied between the normal data voltages, as indicated by a solid curved line, in the OCB LCD.

It is noted that in the case where only the normal data voltage is applied, as the voltage is lowered, there exists an abnormal region from a voltage 0 to a voltage Vc in which luminance is suddenly dropped as indicated by the dotted curved line.

Presumably, this is because the bent alignment of liquid crystals is broken at a voltage from which luminance starts to be lowered, namely, at below the threshold voltage (Vc).

Thus, in the case where only the normal data voltage is applied, the LCD can be driven only at the voltage region ('A' interval) of above the abnormal region where luminance is monotonous-decreasing stably according to voltages, for example, at a voltage range of above 2V.

This disadvantageously means that a maximum luminance (B1) display of the LCD is limited.

However, in the case where the impulse driving is performed as indicated by the solid curved line, as the voltage is lowered, luminance exhibits the characteristics that it is monotonous-decreasing but without having such an abnormal region where luminance is suddenly dropped.

Therefore, the voltage range from 0V to 2V can be also used as the normal data voltages, and luminance can be increased to B2 which is higher than B1.

According to experimentation, it is noted that B2 has about 30% improved luminance compared with that of B1.

Meanwhile, the reason why the bent alignment is not broken in the exemplary embodiment of the present invention is because, presumably, the second impulse voltage value shown by line (iii) in FIG. 4 has a voltage value of the threshold voltage (Vc) or higher and the voltage of the threshold voltage (Vc) or higher is periodically applied to the liquid crystals.

That is, unless the threshold voltage (Vc) or higher is applied for about 500 ms or longer, the bent alignment of OCD liquid crystals would be broken.

Therefore, in the present exemplary embodiment, in the case of the impulse driving, the period for applying the second impulse voltage is preferably within 500 ms.

In general, as one frame takes a time of 1/60 of a second, 30 frames can be displayed in 500 ms.

Thus, preferably, the second impulse data is applied at intervals of 30 frames or less.

FIG. 7 shows a luminance and bent alignment sustaining power of the LCD according to various exemplary embodiments of the present invention.

FIG. 7 shows a table of luminance and bent alignment according to application periods of the second impulse data (g2).

It is noted that the longer the application period of the second impulse data (g2) is, the stronger the luminance of the LCD becomes but the weaker the power for sustaining the bent alignment of the OCB liquid crystals becomes.

In the above-described exemplary embodiment, a time ratio (namely, the duty ratio) for sustaining the normal data voltage and the impulse data voltage (the first and second impulse data voltage) can be varied, and preferably, it is 1:1 to 4:1.

As described above, in the exemplary embodiment of the present invention, the impulse driving is performed such that the impulse data voltage is applied between the normal data voltages for displaying an image. In this case, the impulse data voltage is divided into the first impulse data voltage and the second impulse data voltage having a voltage value that would not break the bent alignment of the OCB liquid crystals. Referring to the application of the first impulse data voltage between the normal data voltages as the first impulse driving and the application of the second impulse data voltage between the normal data voltages as the second impulse driving, the second impulse driving is performed at every two or more first impulse drivings so as not to break the bent alignment of the liquid crystals and to thereby improve luminance of the LCD.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A liquid crystal display (LCD) comprising:

first and second electrodes formed to face each other; and a liquid crystal layer formed between the first electrode and the second electrode, and having a bent alignment, wherein a normal data voltage that indicates luminance corresponding to external image information and an impulse data voltage that indicates a lower luminance than a luminance of the normal data voltage with respect to at least one gray level are alternately applied to the first electrode, wherein the impulse data voltage includes a first impulse data voltage with a value that changes according to the external image information and a second impulse data voltage with a value that does not break the bent alignment, a number of applications of the first impulse voltage is two times or more a number of applications of the second impulse voltage, wherein the normal data voltage with respect to a certain gray level has a smaller voltage than a predetermined threshold voltage at which the bent alignment is broken.

2. The LCD of claim 1, wherein a period during which the second impulse data voltage is applied is two times or more a period during which the first impulse data voltage is applied.

3. The LCD of claim 1, wherein a period during which the second impulse data voltage is applied is not greater than 500 ms.

4. The LCD of claim 3, wherein the period during which the second impulse data voltage is applied is within a range of 2 frames to 30 frames.

5. The LCD of claim 1, wherein the second impulse data voltage refers to data that indicates black.

6. The LCD of claim 1, wherein, in the first impulse data, certain portions that are below a certain gray level refer to data that indicates black.

7. The LCD of claim 6, wherein, in the first impulse data, a portion at a highest gray level refers to data that indicates white.

8. The LCD of claim 1, wherein the liquid crystal display is in a normally white mode.

9. The LCD of claim 1, wherein a time ratio for sustaining the normal data voltage and the impulse data voltage is a duty ratio of 1:1 to 4:1.

10. The LCD of claim 1, wherein:

a plurality of pixels are formed in a matrix form by the first and second electrodes and the liquid crystal layer; and after the normal data voltage is applied to all of the plurality of pixels, one of the first and the second impulse data voltages is applied to all of the plurality of pixels.

11. The LCD of claim 1, wherein:

a plurality of pixels are formed in a matrix form by the first and second electrodes and the liquid crystal layer; and the normal data voltage is applied to some of the plurality of pixels and one of the first and the second impulse data voltages is applied to the remaining pixels.

12. The LCD of claim 1, further comprising a polarizer attached to each outer side of the first and second electrodes.

13. The LCD of claim 12, wherein transmissive axes of each of the polarizers are perpendicular to each other.

14. The LCD of claim 12, further comprising a compensation film attached on an inner side of each polarizer.

15. The LCD of claim 14, wherein one of a C plate compensation film and a biaxial compensation film is used as the compensation film.

16. The LCD of claim 1, wherein the second impulse data voltage does not break the bent alignment when the second impulse data voltage is less than the predetermined threshold voltage.

17. The LCD of claim 1, wherein the predetermined threshold voltage is greater than 0 volts.

* * * * *